United States Patent [19]

Despot et al.

[11] Patent Number: 4,625,642

[45] Date of Patent: Dec. 2, 1986

[54] INKING UNIT OF A ROTARY OFFSET PRESS

[75] Inventors: Janko Despot, Offenbach am Main; Hans Kibler, Heusenstamm, both of Fed. Rep. of Germany

[73] Assignee: M.A.N. Roland Druckmaschinen Aktiengesellschaft, Fed. Rep. of Germany

[21] Appl. No.: 796,078

[22] Filed: Nov. 7, 1985

[30] Foreign Application Priority Data

Nov. 9, 1984 [DE] Fed. Rep. of Germany ..... 3440895

[51] Int. Cl.[4] ..... B41F 31/34; B41L 27/36

[52] U.S. Cl. ..... 101/352

[58] Field of Search ..... 101/349, 351, 352, 363, 101/348, 148, 206, 207–209

[56] References Cited

U.S. PATENT DOCUMENTS

| | | | |
|---|---|---|---|
| 3,611,924 | 10/1971 | Harrison | 101/352 |
| 3,635,160 | 1/1972 | Specht et al. | 101/352 |
| 4,214,527 | 7/1980 | Kamoth | 101/352 |

FOREIGN PATENT DOCUMENTS

| | | |
|---|---|---|
| 3112745 | 11/1983 | Fed. Rep. of Germany . |
| 443355 | 2/1968 | Switzerland . |

*Primary Examiner*—J. Reed Fisher

*Attorney, Agent, or Firm*—Leydig, Voit & Mayer

[57] ABSTRACT

An inking unit for a rotary offset press wherein transfer and applicator rolls are normally externally accessible only after pivoting around one or more non-displaceable transfer rolls, or after the removal of such rolls, including at least two applicator rolls mounted in pivoted levers and having provision for engaging and disengaging companion transfer rolls, the pivoted levers of the applicator rolls being mounted on eccentric bushings having provision for adjusting the pivoted levers relative to engaging the companion non-displaceable transfer roll, characterized by a first transfer roll engaging a pair of inner applicator rolls and all the other displaceable transfer rolls being mounted for engagement with the non-displaceable transfer rolls in a single mounting arm, with the mounting arm being mounted on an eccentric collar disposed centrally on the axis of the non-displaceable transfer roll, and with the arm being pivotable through 180° so that it can be lowered together with the center of the eccentric, and the first transfer roll can be pivoted clockwise, together with the mounting arm, out of the inking unit with the other displaceable transfer rolls removed, and at least three of the other applicator rolls being mounted in levers respectively pivotable around the non-displaceable transfer rolls for consecutive engagement with the plate cylinder.

3 Claims, 4 Drawing Figures

INKING UNIT OF A ROTARY OFFSET PRESS

FIELD OF THE INVENTION

The present invention relates generally to an inking unit for a rotary offset press, and more particularly concerns an inking unit having transfer and applicator rolls which are externally accessible only after pivoting around a non-displaceable transfer roll.

BACKGROUND OF THE INVENTION

The inking unit of the present invention employs at least two applicator rolls mounted in pivoted levers and disposed for engaging and disengaging transfer rolls with the pivoted levers of the applicator rolls being mounted on eccentric bushing having provision for adjusting the pivoted levers relatively to the engaging non-displaceable transfer roll. Inking units of this general kind are known, for example, from German patent application No. F 6910 dated Aug. 6, 1951, Swiss patent application No. 443 355 and German patent specification No. 3 112 745 (copies of which are submitted herewith).

The means thus disclosed enable one or two rolls to be pivoted around another non-displaceable applicator or transfer roll for access to inner rolls covered by outer rolls or in some other way, to facilitate servicing adjustment or demounting. However, pivoting of this kind is unsatisfactory if inner applicator rolls and transfer rolls of this kind are disposed exclusively in an inking unit accessible from only one side, for in this case not only does it become difficult to gain access for the adjustment and replacement of other rolls, but also access to the complete inking unit is blocked. Inking units of this kind must therefore be adapted to be released as a whole from the printing unit for convenient adjustment and replacement of the applicator rolls. This step is, of course, quite expensive.

OBJECTS AND SUMMARY OF THE INVENTION

Accordingly, it is the primary aim of the present invention to provide an inking unit which, in cases where more than two applicator and/or transfer rolls are concealed by outer rolls or in some other way ready access for servicing on one side can be provided by pivoting around more than two non-displaceable rollers, so that an inking unit of this kind can be rigidly connected to the printing unit.

This problem is solved by the mechanism of the present invention wherein a first transfer roll enages a pair of inner applicator rolls and all the other displaceable transfer rolls are mounted for engagement with the non-displaceable transfer rolls in a single mounting arm, with the mounting arm being mounted on an eccentric collar disposed centrally on the axis of the non-displaceable transfer roll, and with the arm being pivotable through 180° so that it can be lowered together with the center of the eccentric, and the first transfer roll can be pivoted clockwise, together with the mounting arm, out of the inking unit with the other displaceable transfer rolls removed, and at least three of the other applicator rolls being mounted in levers respectively pivotable around the non-displaceable transfer rolls for consecutive engagement with the plate cylinder.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENTS

Figure 1:
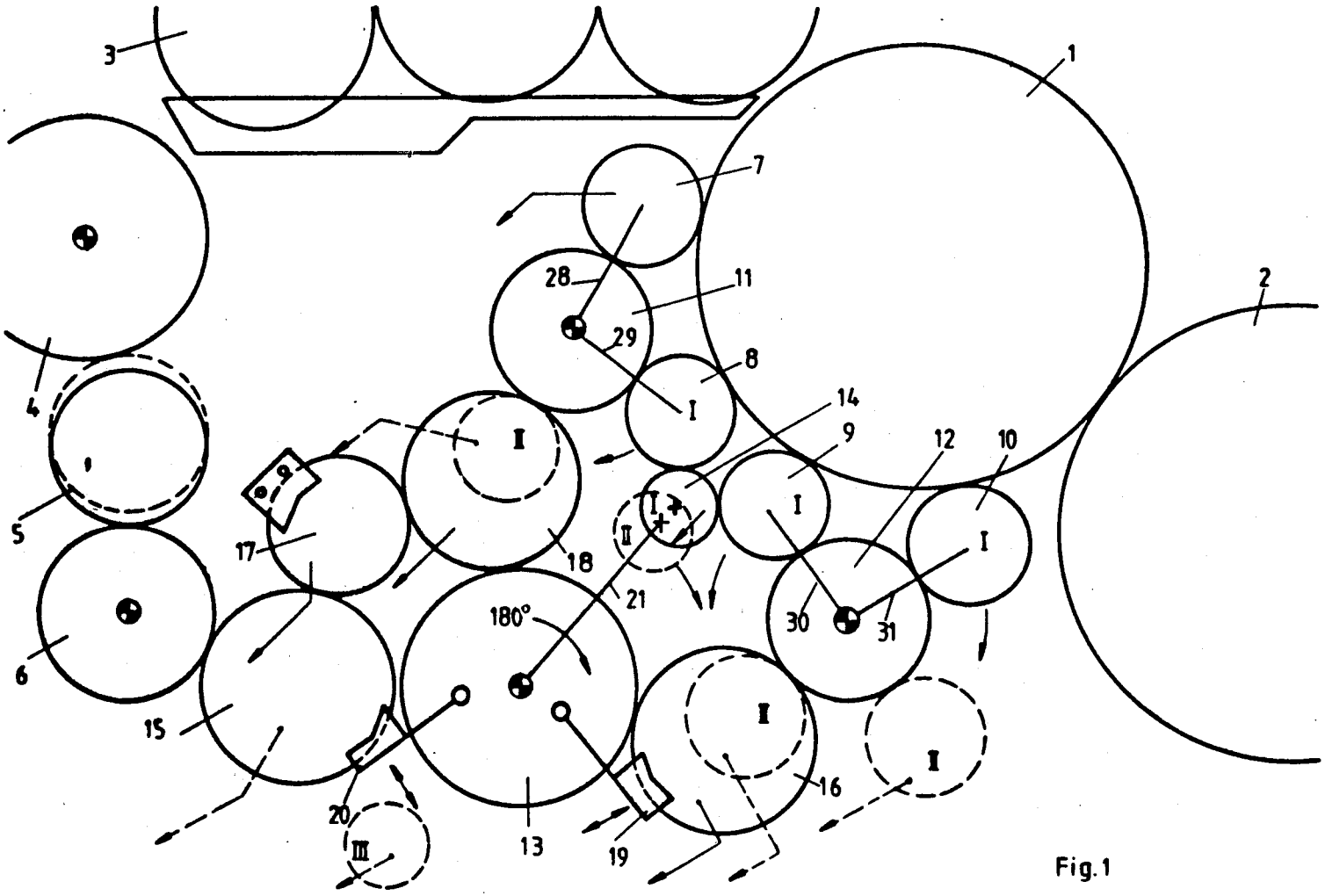
FIG. 1 is a diagrammatic, side elevational view of an inking unit according to the invention.

The inking unit diagrammatically shown in FIG. 1, is supplied conventionally with damping agent by way of a damping unit 3, while the ink needed to ink the plate cylinder 1 is supplied by way of ink duct roll 4, vibrator roll 5 and transfer roll 6. The ink is then transferred by way of transfer rolls 15, 17, and 18 to an upper non-displaceable transfer roll 11 and by way of another non-displaceable transfer roll 13 and by a removable transfer roll 16 to a bottom non-displaceable transfer roll 12. Consecutively disposed applicator rolls 7–10 transfer the finely spread film of ink from the non-displaceable transfer rolls 11, 12 to the plate cylinder 1. A further transfer roll 14 is provided for interconnecting the applicator rolls 8 and 9.

As can be gathered from FIG. 1, after a number of changeover operations, the applicator rolls 8–10 and the transfer rolls 14–18 can be removed from below. Normally, it is impossible to provide access to the applicator rolls 7–10 for servicing and to remove and/or adjust them, unless the complete inking unit is disengaged from the printing unit. This limitation is, however, overcome by the present invention.

Figure 2:
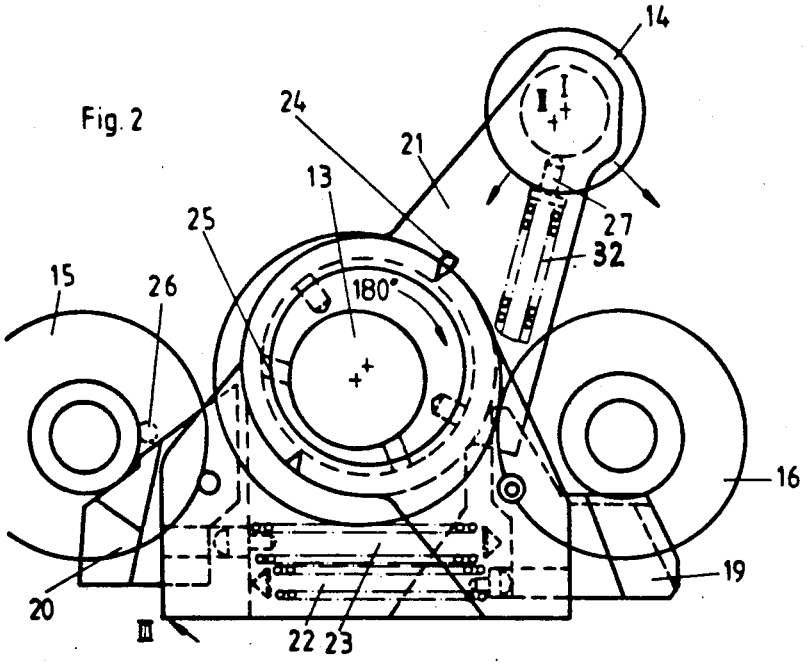
FIG. 2 is a fragmentary end view showing a preferred mechanism for pivoting one transfer roll around another non-displaceable transfer roll.

As shown in FIG. 2, the transfer roll 14 (which engages the inner applicator rolls 8, 9) and the displaceable transfer rolls 15–18 are mounted, in engagement with non-displaceable transfer rolls 6 and 11–13, in a single mounting arm 21 with the interposition of springs 22, 23, 32. In order to clean or service rolls 14–16, the transfer rolls 15, 16 are first removed from their spring-biased levers 19, 20, with simultaneous reduction of the load on the transfer rolls 17, 18 so that they can be withdrawn. Thereafter, by releasing an indexing pin 24, an eccentric collar 25 disposed centrally of the transfer roll 13 on the stationary axis thereof can be rotated through 180°, as shown in FIG. 2 and if the spring 32 is first unstressed, the arm 21 can be moved together with the center of the eccentric and with the transfer roll 14 from position I to position II, as shown in FIG. 1. Preferably, an indexing pin (not shown) engages in a bore 26 in the press column and secures the arm 21 in this position in which all the applicator rolls can be adjusted or cleaned from below. Moreover, the transfer roll 14 can be removed by hinging down a ball catch lever (not shown) at the end of arm 21.

After the work needed to adjust or replace the applicator rolls 7–10 has been carried out, the previously removed transfer rolls 14–18 can easily be engaged in their mountings without any need for further adjustment of the pivoted rolls relative to the non-displaceable transfer rolls 6 and 11–13.

In the preferred embodiment, all of the applicator rolls 7–10 are mounted in levers 28–31 pivotable around the non-displaceable transfer rolls 11–12. To this end, the levers 28, 29 and 30, 31 are engaged by pivoting mechanisms adapted to provide a non-positive connection between the applicator rolls 7–10, the associated non-displaceable transfer rolls 11, 12 and the plate cylinder 1. Alternatively, stop locking can be effected after an appropriate changeover to enable the applicator rolls 8–10 to be removed readily from their mountings after opening of the respective roll lock mechanisms.

Figure 3:
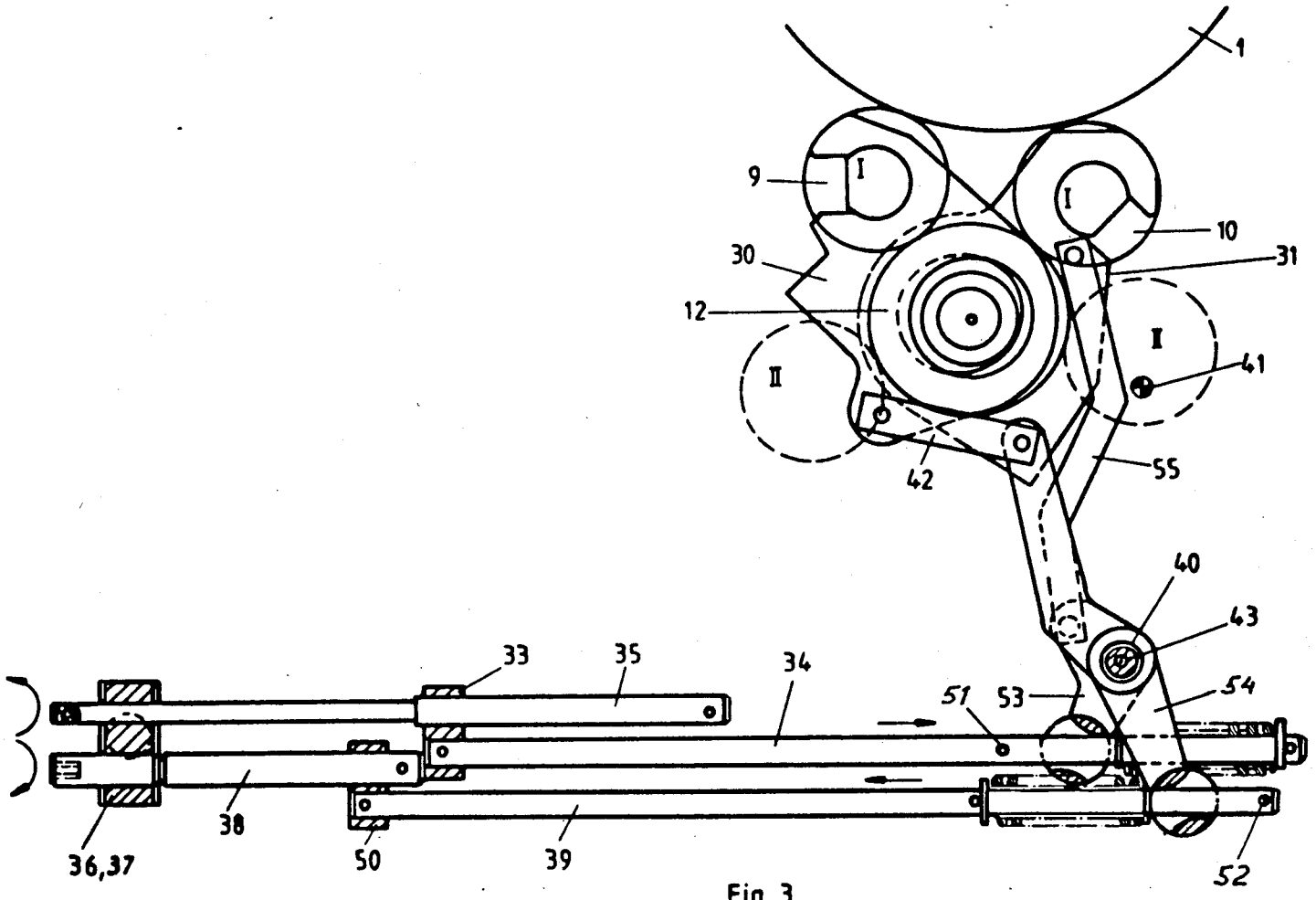
FIG. 3 is a fragmentary end view showing a preferred mechanism for pivoting a pair of applicator rolls around a stationary transfer roll; and, FIG. 4 is a fragmentary end view showing a preferred mechanism for pivoting one of two applicator rolls around another non-displaceable transfer roll.

As shown in FIG. 3, the mechanism for pivoting the applicator rolls 9, 10 around the transfer roll 12 comprises pivoted levers 53, 54 which are rotatable on pins 40 and a collar 43. Resilient rods 34, 39 are slidingly disposed on one end of the levers 53, 54 respectively, and are movable in the direction indicated by arrows in FIG. 3. This is achieved by opposite rotation of screw-threaded rods 35, 38 respectively mounted in bearing pins 36, a spiral clamping pin 37 and intermediate members 33, 50 so that the levers 30, 31, pivoted on the other side of the levers 53, 54, can be pivoted either with the applicator roll 9 by way of a link 42 or with the applicator roll 10 by way of a link 55. When the rods 35, 38 rotate the compressing spring of the associated resilient rods 34, 39 is first unstressed, the associated pin 51, 52 abuts the levers 53, 54, so that in further rotation the levers 30, 31 can be moved with their bearings around the non-displaceable transfer roll 12 with the applicator rolls 9, 10 from position I to position II (See FIGS. 1 and 3). Desirably, a limit pin 41 limits the travel of the applicator roll 9. After the appropriate bearing locks have been opened, the applicator rolls 9, 10 can be replaced or removed for cleaning.

Figure 4:
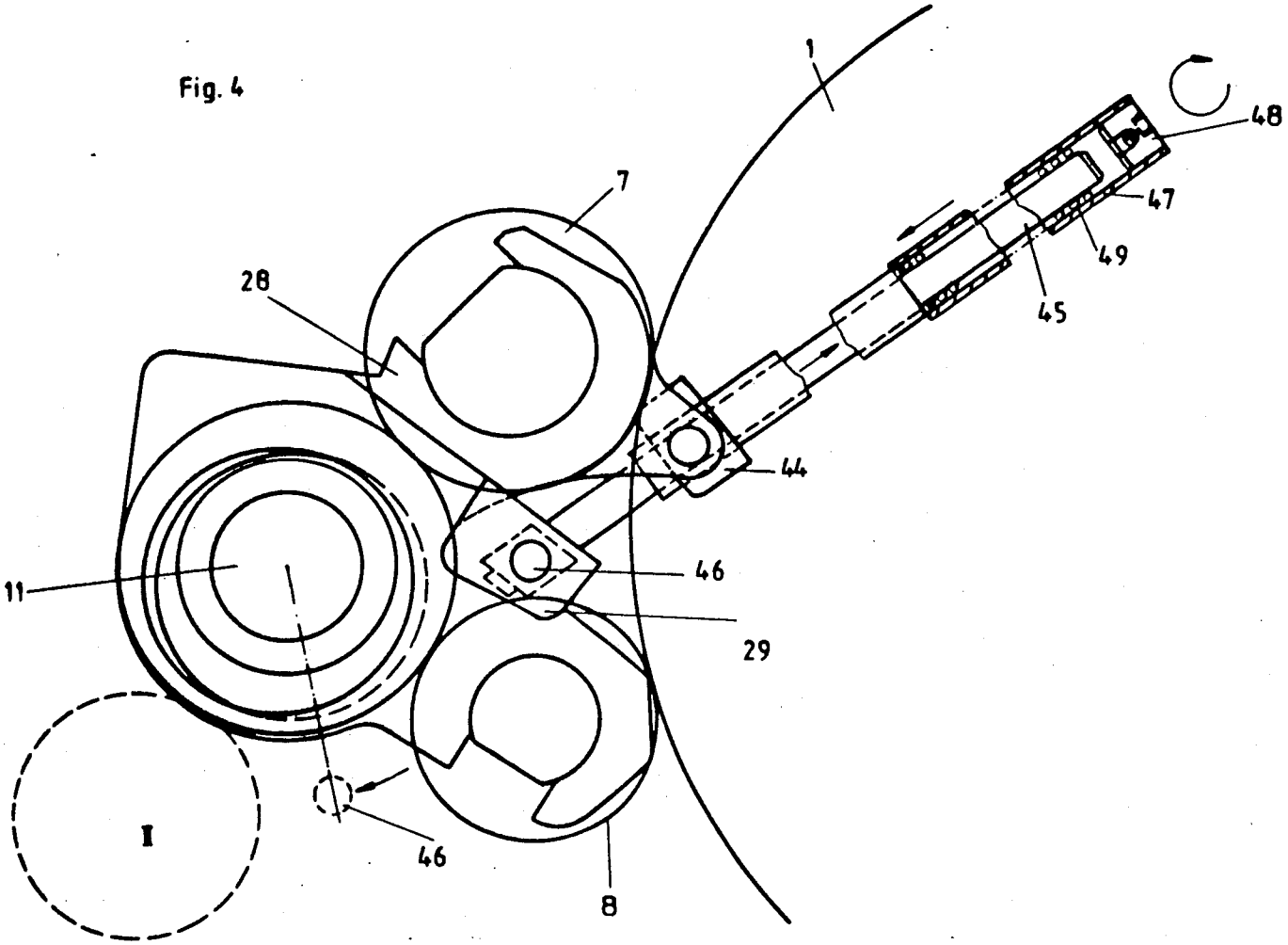

The preferred mechanism for engaging and disengaging the applicator rolls 7, 8 and for pivoting the applicator roll 8 around the non-displaceable transfer roll 11 is shown in FIG. 4. To this end, a rod 45 biased by a spring 49 is pivotally connected by way of a joint 46 to lever 29 supporting applicator roll 8. The rod 45 slides in a resilient tube 47 screwable by way of plugs 48 into a socket 44. The socket 44 is pivotally connected to lever 28 of applicator roll 7 which does not pivot. When the tube 47 is screwed downwardly, the spring 49 is first unstressed, whereafter the lever 29 pivots with its bearing around the non-displaceable transfer roll 11, with the applicator roll 8 being carried by the lever 27 into the position II shown in broken lines in FIG. 4. In this position, the applicator roll 8 can be easily replaced or removed for cleaning.

According to the illustrations, the levers 28–31 are mounted on respective eccentric collars adjustable by known means such as worm drives so that the applicator rolls 7–10 can be adjusted relative to the respective non-displaceable transfer rolls 11–12 by variations of the between-axes distances. All the bearings of the applicator rolls 7–10 experience, by way of the mechanisms for pivoting around non-displaceable transfer rolls 11, 12, a resilient torque which is responsible for the adjustable enagement of the applicator rolls 7–10 with the plate cylinder 1 and also for the stop position for replacing the applicator rolls 8–10.

It can be seen from the foregoing that because of the construction of the inking unit according to the invention, the consecutively disposed applicator and transfer rolls 7–10, and 14 can, after an appropriate changeover, all be removed from one side—i.e., downwardly. Accordingly, ready access for servicing is possible to an inking unit having more than two inner applicator and/or transfer rolls without any need to remove the complete inking unit, which is preferably one that works upwardly, from the 5-cylinder printer unit.

We claim as our invention:

1. An inking unit for a rotary offset press having a plat cylinder comprising a plurality of externally accessible non-displaceable transfer rolls and a plurality of inner displaceable transfer and applicator rolls which are externally accessible only after pivoting around one of the non-displaceable transfer rolls, or after the removal of such rolls, at least two of the inner displaceable applicator rolls being mounted in pivoted levers and having provision for engaging and disengaging a respective one of the non-displaceable transfer rolls, the pivoted levers of the inner displaceable applicator rolls being mounted on eccentric bushings having provision for adjusting the pivoted levers relative to the respective non-displaceable transfer rolls, characterized by a first displaceable transfer roll engaging a pair of the inner displaceable applicator rolls and at least a pair of the displaceable transfer rolls being mounted for engagement with the non-displaceable transfer rolls, said first and said pair of the displaceable transfer rolls being journalled for rotation in a single mounting arm mounted on an eccentric collar disposed centrally on the axis of said one non-displaceable transfer roll, and said arm being pivotable through 180°, so that said mounting arm can be lowered together with the center of the eccentric, whereby said first displaceable transfer roll can be pivoted clockwise, together with said mounting arm, out of the inking unit with said pair of displaceable transfer rolls removed, and at least three of said displaceable applicator rolls being mounted in levers respectively pivotable around said non-displaceable transfer rolls for consecutive engagement with the plate cylinder.

2., An inking unit as defined in claim 1 wherein said mounting levers for two of said three displaceable applicator rolls include toggle links for pivoting said two displaceable applicator rolls around said one non-displaceable transfer roll.

3. An inking unit as defined in claim 1 wherein said mounting lever for one of said three displaceable applicator rolls is connected by a threaded spring biased rod to a stationary mounting of a fourth applicator roll for pivoting said one displaceable applicator roll around said one non-displaceable transfer roll.

* * * * *